US006691765B2

(12) United States Patent
Sparks et al.

(10) Patent No.: US 6,691,765 B2
(45) Date of Patent: Feb. 17, 2004

(54) PRODUCTS FOR THE MANUFACTURE OF MOLDS AND CORES USED IN METAL CASTING AND A METHOD FOR THEIR MANUFACTURE AND RECYCLE FROM CRUSHED ROCK

(75) Inventors: Robert E. Sparks, Kirkwood, MO (US); Kenneth Hillel Peter Harris, Asker (NO)

(73) Assignee: Noram Technology, Ltd., London (GB)

( * ) Notice: Subject to any disclaimer, the term of this patent is extended or adjusted under 35 U.S.C. 154(b) by 12 days.

(21) Appl. No.: 09/922,862

(22) Filed: Aug. 7, 2001

(65) Prior Publication Data

US 2003/0111202 A1 Jun. 19, 2003

(51) Int. Cl.[7] ..... B22C 5/18; B02C 19/06

(52) U.S. Cl. ..... 164/5; 164/131; 164/412; 241/5; 241/14; 241/24.1

(58) Field of Search ..... 164/5, 131, 132, 164/412; 241/5, 14, 24.1

(56) References Cited

U.S. PATENT DOCUMENTS

| | | | |
|---|---|---|---|
| 1,420,593 | A | 6/1922 | Titchmarsh |
| 3,312,403 | A | 4/1967 | Zifferer |
| 3,385,436 | A | 5/1968 | Murphy |
| 3,764,078 | A | 10/1973 | Richard |
| 3,863,847 | A | 2/1975 | Day et al. |
| 3,933,626 | A | 1/1976 | Stukel et al. |
| 3,979,073 | A | 9/1976 | Leliaert |
| 4,039,625 | A | 8/1977 | Davis |
| 4,050,635 | A | 9/1977 | Mueller et al. |
| 4,115,985 | A | 9/1978 | Venot |
| 4,137,675 | A | 2/1979 | Cina et al. |
| 4,154,894 | A | 5/1979 | Bushey |
| 4,177,952 | A | 12/1979 | Rikker |
| 4,213,852 | A | 7/1980 | Etkin |

(List continued on next page.)

FOREIGN PATENT DOCUMENTS

| | | |
|---|---|---|
| DE | 100889 | 10/1973 |
| DE | 3021490 | 12/1981 |
| EP | 0074771 | 3/1983 |
| EP | 0099470 | 2/1984 |
| EP | 0107752 | 5/1984 |
| RU | 2043821 | 9/1995 |
| WO | WO 9426438 | 11/1994 |

OTHER PUBLICATIONS

GE Classifiers, "Gravitational Classifier", Oct. 1992, p. 1.1.
Modern Casting, "Silica Threatens Your Existence", Alfred T. Spada, Feb. 2000.

(List continued on next page.)

*Primary Examiner*—Kuang Y. Lin
(74) *Attorney, Agent, or Firm*—Jacobson Holman PLLC

(57) ABSTRACT

A system and method for producing foundry quality sand from non-conventional starting materials through the combination of oolitization and classification. Incoming particulate matter is first directed into a controlled energy attrition unit where the particles are made to collide with one another. Such collisions clean and round the particles by chipping away surface projections and coatings without crushing the particles. The particle stream is then directed through a multi-fraction classifier where it is separated into two or more useable grades of foundry sand. An air classifier is preferred for the classification stage.

13 Claims, 8 Drawing Sheets

U.S. PATENT DOCUMENTS 4,321,186 A * 3/1982 Allison, III ..... 523/139
4,354,641 A 10/1982 Smith
4,361,404 A 11/1982 Colin et al.
4,449,566 A 5/1984 Filipovitch et al.
4,491,277 A 1/1985 Bauer et al.
4,514,168 A 4/1985 McMath et al.
4,566,637 A 1/1986 Deve
4,574,045 A 3/1986 Crossmore, Jr.
4,575,013 A 3/1986 Bartley
4,604,140 A 8/1986 Lalancette et al.
4,636,168 A 1/1987 Sandstrom et al.
4,671,867 A 6/1987 Battie et al.
4,702,304 A 10/1987 Rice
4,735,973 A 4/1988 Brander
4,738,615 A 4/1988 Bailey et al.
4,978,076 A 12/1990 Andrews et al.
4,980,394 A 12/1990 Lemon
5,019,302 A 5/1991 Sparks et al.
5,032,256 A 7/1991 Vickery
5,045,090 A 9/1991 Pohl
5,094,289 A 3/1992 Gentry
5,100,592 A 3/1992 Sparks et al.
5,163,562 A 11/1992 Wilhelm et al.
5,219,123 A 6/1993 Jacob
5,271,450 A 12/1993 Bailey
5,279,741 A 1/1994 Schott
5,289,920 A 3/1994 Godderidge et al.
5,299,618 A 4/1994 Fumagalli
5,423,370 A 6/1995 Bonnemasou et al.
5,520,341 A 5/1996 Boenisch
5,706,879 A 1/1998 Renner et al.
5,794,865 A 8/1998 Didion et al.
5,865,236 A 2/1999 Hansen et al.

* cited by examiner (All dimensions are in mm)

10
12
FEED
Screen
16
14
AIR
Honeycomb
RECEIVERS
5.5"
5.5"
5.5"
5.5"
12"
12"
12"
18.5"
A B C D E E E E E
PRODUCT FRACTIONS
AIR EXIT WITH VERY FINE PARTICLES (Fraction J)

Particle Size Range vs. Distance
without Screen Section
(No Vibrating Screen Feeder)

D60/D10 vs. Distance At Three Feed Rates & With Screen Section in Place

AIR INLET TO PARTICLE RECEIVER
(SCREENS USED TO GIVE
UNIFORM UPWARD VELOCITY)

PRODUCTS FOR THE MANUFACTURE OF MOLDS AND CORES USED IN METAL CASTING AND A METHOD FOR THEIR MANUFACTURE AND RECYCLE FROM CRUSHED ROCK

BACKGROUND OF THE INVENTION

1. Field of the Invention

The present invention is related to the field of metal casting and, more particularly, to a system and method for producing foundry quality sand from non-conventional starting materials, and for classifying the sand so produced into two or more foundry grade products.

2. Description of the Related Art

Most foundry sand is made by sieving or wet classifying naturally occurring silica or quartz sand. (As used herein, "quartz sand" is intended to refer to sand containing silica as is found in quartz in crystalline form. As used herein, "non-quartz sand" is intended to refer to sand which does not contain a significant amount of silica.) Quartz sand suitable for casting contains low levels of compounds of alkali and alkaline earth metals, of both organic and inorganically bonded carbon and of halogen and sulphur derivatives. Such sand consists of rounded particles with weight average mean particle sizes of 0.15 mm or more and narrow size distributions, with typically more than 90% of the particles within 0.5 to 1.5 of the mean.

In some cases, the thermal or physical characteristics of quartz sand are unacceptable and foundries are obliged to use other sands with better properties. These non-quartz alternatives are much less common and greatly more expensive than quartz sand and include olivine (ferriferous magnesium silicate), chromite (ferrous chromite, $FeCr_2O_4$), and zircon (zirconium orthosilicate, $ZrSiO_4$). The greater expense of the alternatives to quartz proscribes their general use, and foundries that make particularly demanding precision parts commonly use quartz sand or a recycled sand mixture containing an appreciable fraction of quartz sand for making the external parts of molds, and new non-quartz sand for making the internal parts or cores of the molds.

Foundry sand must resist the temperatures encountered in the casting process, and should not react adversely with the binders used to make molds and cores. It should pack well so that its bulk density is high, yielding a smooth surface on the cast metal product, yet be porous enough to allow the easy escape of gas formed during casting. High bulk density is achieved by using naturally occurring rounded particles that can easily move over one another and which have as broad a size distribution as possible. However, good porosity requires low levels of fine particles, whilst smooth casting surfaces require low levels of large particles; both of these factors limit the breadth of the particle size distribution. A typical high quality quartz sand consists of rounded grains whose particle size distribution is a compromise between these demands, with at least 95% of the particles being within ±75% of the mean size and with less than 2% of the particles being below one quarter of the mean size.

The combination of physical and chemical properties required of a quartz foundry sand limit the number of locations where such products occur naturally. Sand may therefore need to be shipped over considerable distances, making quartz foundry sand considerably more expensive than local ordinary builder's sand. Many countries, particularly those located in the drier parts of the world such as northern Africa and the middle East, lack indigenous sources of quartz suitable for use as foundry sand and must import foundry sand at considerable cost from northern and western Europe.

A further factor limiting the number of locations that can supply quartz foundry sand is that much quartz sand, e.g. beach sand, is contaminated with shell or bone fragments or limestone particles that seriously interfere with casting procedures. Such interference is created by the fact that these contaminants may react with commonly used binders and/or decompose at the temperatures typically used to cast metals.

Not only does quartz present difficulties in availability, the use of quartz has been associated with respiratory ailments. The World Health Organization has officially classified quartz dust as a carcinogen. Hence, quartz sand is the subject of restrictions and precautions in the workplace, and the spent sand, particularly the dust from foundry filters which contains elevated levels of quartz dust, is similarly restricted. This limits the useful employment of spent quartz sand in concrete and asphalt.

Another weakness associated with quartz is its non-linear coefficient of thermal expansion. Quartz undergoes a crystalline transition at ca. 560° C. which is accompanied by a considerable increase in volume. Since different parts of the mold are at different temperatures during casting, they expand unevenly and cracks develop, into which molten metal can penetrate. After casting, these metal intrusions appear as thin wafers that protrude from the casting and have to be removed in time consuming finishing operations. At worst, the cast part may need to be scrapped. This phenomenon, known as "finning" is the most common cause of scrap in metal casting.

Like quartz, the currently available alternatives to quartz are also environmentally suspect. Olivine is highly alkaline and can contain nickel and in some cases asbestos, all of which can cause irritation to skin and lungs; together with chromite both are considered toxic waste and must be disposed of in special dump sites. Zircon is weakly radioactive, requiring workplace precautions and dump site limitations.

The sources of currently used alternatives to quartz sand are far fewer in number and most are located outside of the areas where there are large numbers of foundries; this means that they bear considerable freight cost penalties compared to quartz sand. Furthermore, and unlike quartz sand, they also have relatively highly valued alternative applications. For example, zircon and olivine are used in the manufacture of refractories, whilst chromite is the ore used in the manufacture of chromium metal. These factors make these alternative sands as much as ten or twenty times more expensive than quartz sand and they are therefore rarely used as the sole sand in a foundry.

Given the difficulties in obtaining suitable sand, it is important to consider the "life" of the sand. After use, foundry sand is either dumped, used for non-foundry purposes such as construction materials or reused. Because spent foundry sand can contain organic materials, acids and heavy metals, environmental authorities usually insist that it must be dumped at an approved site for toxic waste; this adds considerably to the foundry's total sand related costs. Financial and environmental considerations encourage measures that minimize the net use of sand, including recovery and reuse of the sand by recycling the spent molds and/or cores. For these reasons, many foundries find it economically viable to install equipment that recovers and reuses spent sand.

The reuse of spent sand requires that extraneous material such as char and residual binder be removed as completely as possible. Spent molds and/or cores are broken into smaller and more easily handled aggregates, typically using a vibrating screen. Char and residual binder are then removed. Sand recovery equipment typically uses either thermal or mechanical methods.

Thermal treatment entails heating the sand to 700° C. or more in an excess of air so that organic binders are burnt off. The treated sand is then fluidized in an air stream to remove dust before being reused. Such thermal processes remove organic binder residues by incineration; they yield sand of fair quality but are energy intensive, costly and not suitable for all sand/binder combinations. They also lead to emissions of environmentally undesirable gases (oxides of sulphur, nitrogen and carbon).

State of the art attrition involves gently and repeatedly rubbing the sand grains against one another so that loosely held interstitial binder and char is converted to dust. Such mechanical processes are less costly but the quality of the recovered sand is inferior and its use within the foundry often more restricted than that of new or thermally reclaimed sands. Both thermal and mechanical recovery methods remove dust by means of cyclones or fluidized beds.

Recovery of used sand is significantly complicated by the fact that different sand types are sometimes used for the molds and cores. Once the casting process is complete, it is rarely feasible to separate the used molds and cores from one another, so the different sands used for these two purposes become mixed. State of the art recycling methods are unable to satisfactorily separate this mixture into its component parts and foundries that use both costly non-quartz sand and cheaper quartz sand must therefore replenish their non-quartz sand with new material after each casting cycle.

In other cases, foundries that would prefer to use and recycle two grades of the same sand, e.g., one for making the mold and another of different particle size distribution for making the core, are unable to do so because limitations in state of the art recycling methods do not allow such closely similar materials to be easily separated. They must therefore either choose to compromise by selecting and recycling one grade of sand for all purposes, or continually buy new sand for the one application and use a suboptimal mixed recycled product for the other.

The proportion of sand that can be recycled can also be limited by the binder system used, since some binders react with quartz at casting temperatures; these include some of the most commonly used binders that contain highly alkaline materials such as sodium silicate or mixtures of phenolic resins with caustic alkalis. These binder resins are difficult to remove, either by attrition or thermal treatment and, when heated during thermal recycle or subsequent casting, may react with the sand to form silicates of low melting point that seriously compromise the refractory characteristics of the sand.

Foundries are also limited in their choice of classification methods for sand recycling and cannot economically employ methods originally used in large scale manufacture of foundry sand. Wet classification has inordinately high operating costs and yields effluents that pose environmental hazards. Sieves are difficult and costly to use with fine materials and, unless the product fractions are carefully remixed, fail to yield products whose particle size distributions give optimal packing characteristics.

SUMMARY OF THE INVENTION

In view of the foregoing, one object of the present invention is to overcome the difficulties of procuring suitable quality foundry sand through a system and method of producing foundry sand from alternative materials and providing for the recycle of such sand.

Another object of the invention is to achieve close control of both particle shape and particle size through the combination of a mechanical oolitization procedure followed by air classification.

A further object of the invention is a system and method that enables use of locally available, less expensive, quartz and non-quartz materials previously considered unsuitable for foundry sand.

Yet another object of the invention is a system and method for recycling molds and cores to separate and reclaim the sand contained therein for reuse.

An additional object of the invention is a particle classification system that allows for the simultaneous recovery of two or more distinct grades of foundry quality sand from a single input stream.

In accordance with this and other objects, the present invention is directed to the combination of a controlled energy particle-on-particle attrition unit followed by a multi-fraction classifier. Incoming particulate material, which may constitute either raw material for and/or used sand from cores and molds, is placed within the controlled energy attrition unit where the particles collide with one another. Through these collisions, edges, surface projections and coatings of the particles are chipped away but the particles themselves are not crushed. This oolitization procedure rounds and cleans the particles, yielding a sand stream having particles covering a wider size distribution. The sand stream is then directed through the multi-fraction classifier where the sand is classified into two or more useable grades of foundry sand.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
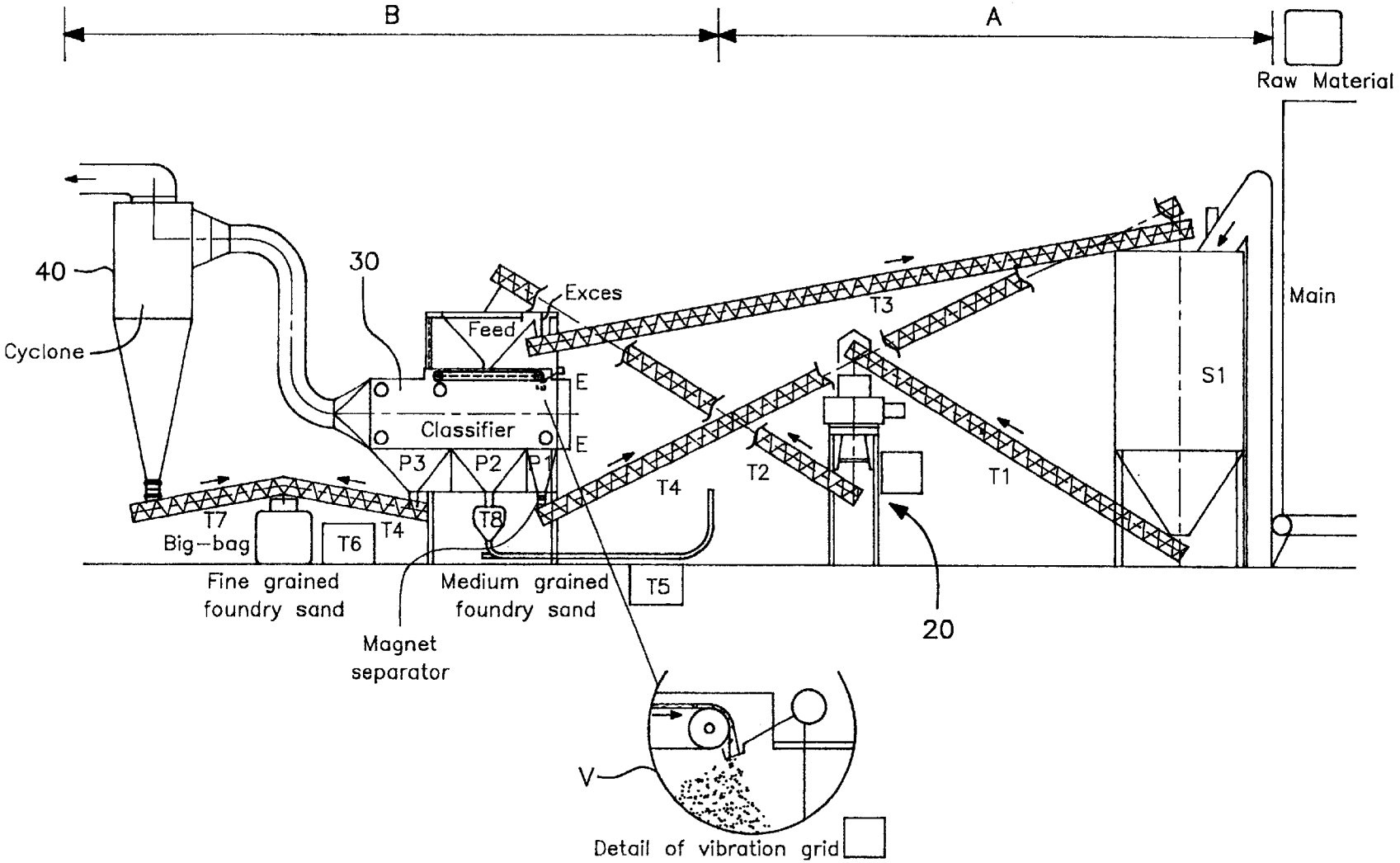
FIG. 1 is a diagram of a plant suitable for producing foundry sand by rounding and classifying particles in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Foundry sand may be defined in accordance with a number of characteristics which make it suitable for use in casting. These include that such sands are practically free from dust, i.e., particles below 75$\mu$, consist of grains that are rounded rather than angular, have a normal particle size distribution where at least 85% of the particles are between 0.5 and 1.5 of the mean diameter and resist abrasion. Minerals used for foundry sand must have high tensile strength and a sufficiently high sintering temperature, and must not be subject to any chemical change that may cause gas to be evolved during casting.

Most foundry sand is selected from naturally occurring deposits of round grained sands, of which silica (quartz) is by far the most common. However, the present invention describes how satisfactory foundry sand can be made from a very wide range of naturally occurring minerals. Such sand is characterized by:

(i) containing less than 10% crystalline quartz and belonging to the feldspar family and having the formula approximately $XAI_{(1-2)}Si_{(3-2)}O_8$, where X can be sodium, potassium or, preferably, calcium, iron or magnesium, or a mixture of such crystals;

(ii) consisting of crystallites smaller than 1 mm and preferably smaller than 0.2 mm in size;

(iii) having a sintering point for the powdered material (defined as the temperature, $T_S$, at which a sample in a Netzsch® dilatometer shows a 1% smaller volume than at temperature $T_S$−30° C.) of at least 750° C. and preferably more than 1000° C.;

(iv) having a thermal expansion of less than 0.5% between 150° C. and 750° C., as measured on compressed powder in a Netzsch® dilatometer;

(v) having a thermal expansion between 150 and 750° C., as measured on compressed powder in a Netzsch® dilatometer such that the extension at temperature T+30° C. is no more than 0.02% greater than at temperature T;

(vi) having a uniaxial compression strength of at least 70 megaPascals measured on a solid specimen;

(vii) having a weight loss on being heated in nitrogen at 100° C. for 2 minutes of less than 0.5%;

(viii) having a weight loss on being heated in nitrogen at 800° C. for 2 minutes of less than 1.5%;

(ix) having a Moh scale hardness of at least 5;

(x) containing less than 5% of the transition metals cobalt, nickel, manganese and chromium; and (xi) having a pH of between 3.5 and 9.1 as measured by ISO 10390:1994(E).

A sand possessing these characteristics may be defined as appropriate for use as foundry sand. Even though a range of minerals meeting these specifications is freely available at attractive prices, many have never been used as foundry sand. The invention described herein is thus a considerable improvement upon the state of the art as it greatly extends the number of raw materials that can be used to produce foundry sand. Suitable materials include, but are not limited to: basalt, anorthite, oligoclase, gehlenite, epidote, cordierite and augite.

Minerals of the feldspar family are extremely common and are said to constitute as much as 60% of all minerals. The foundry sands described here, as produced in accordance with the present invention, can thus be made from a far larger and more widely available range of raw materials than the quartz-based sand presently being supplied to most foundries. The use of such alternative materials will lead to a considerable reduction in the cost of obtaining and using casting sand, particularly for those foundries located far from a source of good quality quartz sand.

The feldspar casting sands described in this invention are particularly advantageous for use in foundries which presently employ quartz sand, since their use will reduce the quantity of quartz particles in the air, thereby improving the working environment and reducing the risk of respiratory disease. Spent sand and filter dust from the products described contain little or no quartz and can be used without risk in applications such as asphalt and concrete.

Since they are neither strongly basic nor radioactive and contain few or no transition metals, the sand products produced in accordance with this invention provide environmental and workplace benefits compared to the current alternatives to quartz sand now in commercial use. The products described herein are also, by virtue of their ubiquity, much cheaper than these alternatives.

The products produced in accordance with the present invention are characterized by having (i) a particle size distribution where less than 2 mass %, and preferably less than 1 mass %, is smaller than one quarter of the weight average particle size and less than 5 mass %, and preferably less than 2 mass %, is greater than three times the weight average particle size; (ii) a weight average mean particle size of less than 1.5 mm and oolitized such that the particles pack well enough to provide a bulk density that is at least 55%, and preferably 60% or more, of the density of the rock from which they are made; and (iii) an ignition loss of less than 3% and, preferably, less than 2%.

Perhaps the greatest benefit of the present invention is the unexpected finding that castings made using cores and/or molds made from products having these characteristics and binders made from synthetic resins or sodium silicate benefit from reduced scrap rates and lower costs associated with finishing operations than when quartz is used. This appears to be due to the fact that feldspar sands have lower and more uniform coefficients of thermal expansion than does quartz, particularly in the temperature range between 100–700° C.

I. The Preparation of Foundry Quality Sand from Crushed Rock

The present invention comprises a technique for making suitable foundry sand from alternative starting materials not heretofore considered usable in casting. This is accomplished by a two-stage process that includes (i) treatment, preferably repeated one or more times, in a controlled energy impactor that causes the particles to collide with or rub against one another such that edges or surface irregularities are chipped away but the particles themselves are not crushed; followed by (ii) classification to separate the resulting sand product into one or more foundry grade products and one or more secondary products. Classification may be accomplished with air or water as the dynamic medium or at a sieving station equipped with the necessary sieves to provide the desired particle size distribution.

In a basic embodiment such as that shown in FIG. 1, the present invention is directed to a plant suitable for converting a physically and thermally suitable mineral into two or more grades of foundry sand. The plant includes a controlled energy impactor or oolitizer 20, and a classifier 30 having at least two and preferably three or more chambers, shown in FIG. 1 as $P_1$, $P_2$, $P_3$, with associated product outlets. The oolitizer 20 should preferably be run at a higher throughput rate than the classifier 30, with the excess being returned to the oolitizer for repeat attrition.

FIG. 1 illustrates a plant capable of upgrading dry particles below 1 mm in diameter, a sieve residue from a rock-crushing operation, to two grades of sand suitable for use in foundries. The plant consists of two processing loops, an oolitization loop, A, and a classification loop, B, loop B being operated at a lower net throughput than loop A. It is advisable that the feed to the oolitizer contains less than 10% by weight of particles that are larger than twice the mean size of the largest foundry sand product to be made in loop B. This can easily be achieved by sieving or prior crushing in a suitable crusher.

Figure 2:
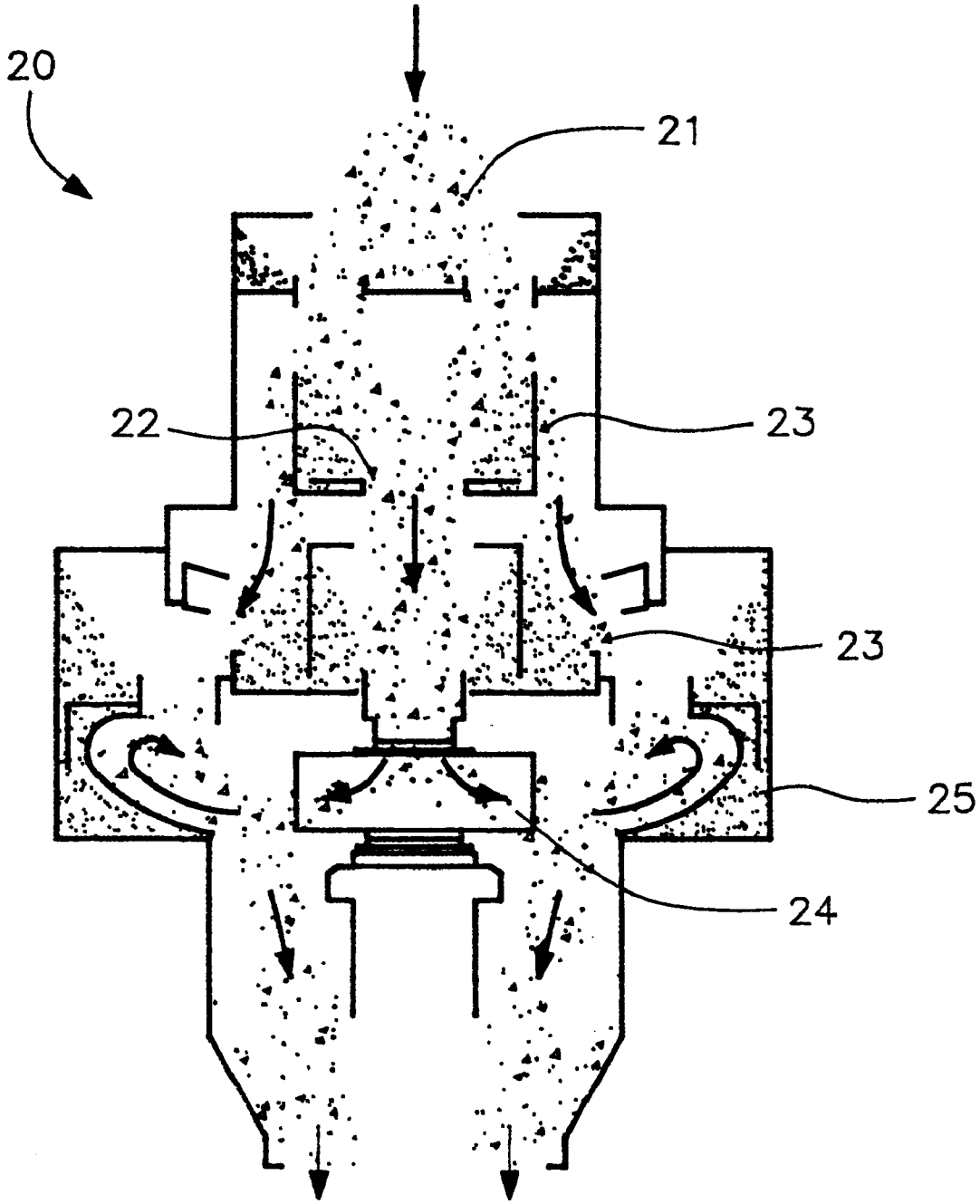
FIG. 2 is a diagram of an oolitizer for use with the present invention.

Loop A includes a storage silo, $S_1$; a controlled energy oolitizer 20; a conveyor, $T_1$, to bring feed from $S_1$ to the controlled energy oolitizer 20; and a conveyor, $T_2$, to transfer material from the oolitizer to the classifier. The controlled energy oolitizer may be embodied as a Barmac® 3000 SD Duopactor, shown representatively in FIG. 2. As shown in FIG. 2, the Barmac® crusher has a feed hopper 21 that centralizes the flow of incoming material. A choke 22 on the control plate controls the flow of material onto the rotor 24. Excess material unable to flow through to the rotor 24 overflows through cascade ports 23. By adjusting the choke 22, the flow of cascading material through the cascade ports 23 may be increased.

The rotor 24 accelerates the incoming material and continuously discharges such material into the crushing chamber 25. Additionally, within the crushing chamber 25, the cascading material recombines with the material accelerated by the rotor. A constant cloud of suspended particles move around the crushing chamber 25. Particles are retained for an average period of 5–20 seconds before losing energy and falling from the chamber. Exit velocities of particles leaving the chamber 25 range from 50–85 m/s. As material leaves the chamber, it is directed by conveyor $T_2$ to the classification loop, Loop B.

Loop B includes an air classifier 30; a conveyor, $T_3$, to transport excess oolitized material back to $S_1$; a conveyor, $T_4$, to transport the largest classified particles (oversize) from $P_1$ to $S_1$; a conveyor, $T_5$, to transport medium foundry sand from $P_2$ to storage; a conveyor, $T_6$, to transport fine foundry sand from $P_3$ to storage (shown here as bagged); a cyclone 40 to remove particles larger than 0.1 mm from the air stream; and a conveyor, $T_7$, to transport the separated particles from the cyclone to fine foundry dust storage. The air classifier includes an eddy dampening unit E, a vibrating grid V to ensure uniform distribution of feed into the classifier, and three product chambers $P_1$, $P_2$ and $P_3$.

During one series of operations of the plant depicted in FIG. 1, the oolitizer 20 was equipped with a 10 kW motor and fed at a rate of 8 $m^3$/h from $S_1$. The oolitizer's choke 22 (feed splitter) was adjusted so that two thirds of the feed fell centrally onto the rotor 24 while the remaining third fell as a cascade outside the rotor through cascade ports 23. The rotor was run at maximum speed.

In the classifier loop, loop B, the oolitized material was fed uniformly across the width of the classifier at a rate of 0.6 liters/second. The vibrating grid was operated with a frequency of 50 Hz and an amplitude of 1.5 mm, and the length of chambers $P_1$, $P_2$ and $P_3$ was 220 mm, 760 mm and 850 mm, respectively. The airflow was 2.1 m/sec. When anothosite, a calcium feldspar, was run under these conditions, fractions were obtained with the particle size distributions as set forth in Table 1.

TABLE 1

| Sieve Fraction, mm | Raw Material[a] | Medium Foundry Sand | Fine Foundry Sand | Filter Dust |
|---|---|---|---|---|
| >0.6 mm | 15% | 10% | 1% | 0 |
| 0.3–0.6 mm | 50% | 42% | 9% | 0 |
| 0.15–0.3 mm | 23% | 38% | 53% | <2% |
| 0.075–0.15 mm | 10% | 9% | 32% | 14% |
| −0.075 mm | 2% | <1% | 2% | 85% |

[a]Crushed anorthosite, dried in a rotating dryer and sieved to remove +0.75 mm.

Through use of the present invention, foundries that currently use quartz sand for mold making purposes and/or together with synthetic resins for making cores will experience a considerable reduction in manufacturing costs per unit of saleable output.

Basalt, a feldspar meeting the specifications for foundry sand as previously set forth, may be made into a casting sand from a crushed 0–4 mm sieve fraction treated in an impactor. Material from the impactor is then classified in an appropriate manner. Table 2 compares the properties of ordinary quartz sand with those of the basalt casting sand made in accordance with this invention.

TABLE 2

PROPERTIES OF BASALT AND QUARTZ CASTING SANDS

| Property | SAND TYPE BASALT | SAND TYPE QUARTZ[a] |
|---|---|---|
| Thermal expansion 20–750° C. | 0.4% | 0.7% |
| Expansion mode | Linear | Discontinuous at 560° C. |
| Sintering temperature, ° C. | 880 | 1,020 |
| Median grain size, mm | 0.31 | 0.28 |
| Particles > 0.7 mm | 3 wt % | 1 wt % |
| Particles < 0.1 mm | 2 wt % | 1 wt % |

[a]Baskarp 28, wet classified

Table 3 compares the properties of ordinary quartz sand with those of a non-quartz sand made from anorthosite according to the method of this invention.

TABLE 3

PROPERTIES OF A NON-QUARTZ SAND (ANORTHOSITE) MADE ACCORDING TO THE INVENTION AND TYPICAL RESULTS OF ITS USE

| Property | SAND TYPE ANORTHOSITE[a] | SAND TYPE NEW QUARTZ[b] |
|---|---|---|
| Thermal expansion 20–750° C. | 0.41% | 0.65% |
| Expansion mode | Linear | Discontinuous at 560° C. |
| Sintering temperature, ° C. | 1,110 | 1,020 |
| Median grain size, mm | 0.31 | 0.28 |
| Foundry scrap rate | 2.2% | 3.1% |
| Quartz particles per $m^3$ workplace air | <0.1 mg | 2.6 mg |
| Binder consumption per unit volume | 1 | 1.15 |

[a]From Nodest AS quarry in Hauge i Dalane, Norway
[b]Baskarp 28

The present invention encompasses the preparation of foundry quality sand from the crushed rock of non-standard materials, and the recycling of foundry sand including used cores and molds to recover two or more grades of useable foundry sand. Each of these aspects will be discussed in turn.

II. Recycled Foundry Sand and the Recovery of Two or More Foundry Grade Products In the recovery of sand from cores and molds, the first step is to crush these cores and molds to aggregates, typically of a maximum particle size of 5 mm. These aggregates are then passed through the controlled energy attrition unit 20. Representatively, the impactor 20 may be embodied as the Barmac Duopactor® or a Rhodax® inertial cone crusher, operated so that at least 80–90% of the resulting product has a particle size of below 1 mm and a content of particles smaller than 75$\mu$ of no more than 15%. During this attrition phase, at least 20% of any organic binder coating the sand surface is reduced to fine particles. The treated sand is then classified, for example in a classifier 30 as described in connection with FIG. 1.

In the classifier 30, the individual particles fall according to their drag per unit of mass so that particles of similar drag per unit of mass concentrate together with one another. Particles whose drag per unit of mass is low enough to allow them to fall to the floor of the classification chamber are separated into at least three fractions by virtue of the three chambers or receiver sections $P_1$, $P_2$, $P_3$, with product outlets as shown. Those particles whose drag per unit of mass is so high that they fail to reach the floor of the chamber, leave together with the air stream and are removed in the cyclone 40 and/or air filter. The air speed through the chamber and/or the position of the dividing walls defining the receiver sections is altered as needed. In the minimum case where the classifier consists of three receiver sections, the first receiver section, $P_1$, will yield an oversized fraction, that is returned to the attrition unit 20 in a sand recycle loop. The second $P_2$ and third $P_3$ receiver sections yield the coarser and finer products, respectively.

Figure 3:
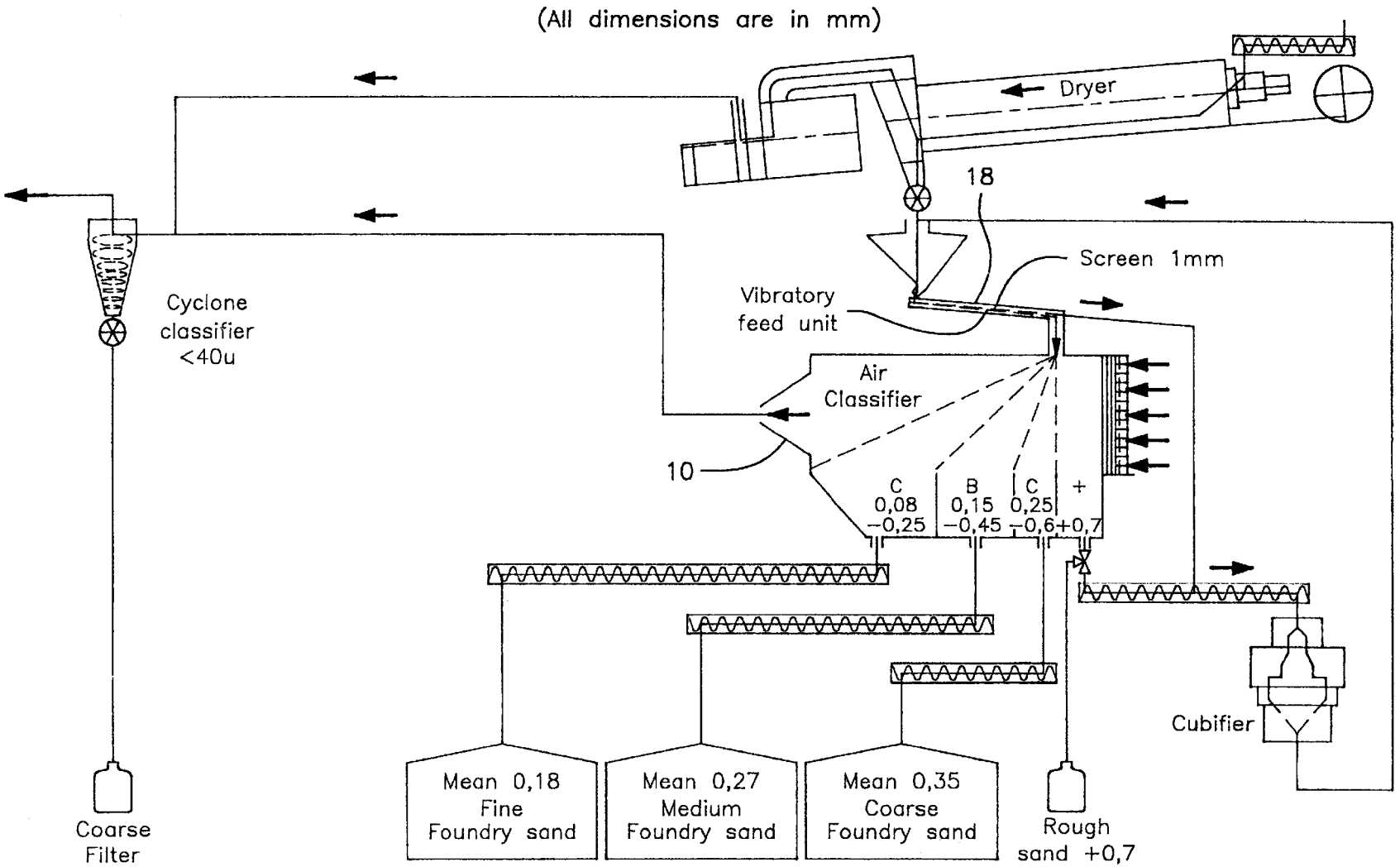
FIG. 3 is a diagram showing an air classifier in accordance with the present invention.

As shown in FIG. 3, material from the impactor 20 may be classified using a four take-off classifier with a chamber 1 m high and 1.2 m wide. Products can be prepared using an air flow of at least 1.0 $M^3sec^{-1}$ and preferably between 1.3–2.5 $M^3sec^{-1}$ per square meter of chamber cross-section, to yield the following classified materials:

i) an oversize fraction collecting in the first receiver section "+" whose mouth extends from (−10 cm) to +30 cm from a point immediately below that at which the feed falls into the chamber;

ii) a large particle product collecting in the second receiver section A whose mouth extends from +30 cm to +70 cm from a point immediately below that at which the feed falls into the chamber;

iii) a small particle product collecting in the receiver section B whose mouth extends from +70 cm to +120 cm from a point immediately below that at which the feed falls into the chamber; and iv) a dust (fines) fraction collecting in receiver section C (120–160 cm from feed entry point) and the air filter.

Table 4 illustrates typical particle size distributions for the fractions made by applying this invention to the recovery of two sands of median grain sizes 0.18 and 0.45 mm in a three chamber classifier from a recycled mixed sand.

TABLE 4

| Sieve interval | Oversize | Coarser product | Finer product | Filter dust |
|---|---|---|---|---|
| <105 $\mu$ | 1 wt % | 2 wt % | 5 wt % | 90 wt % |
| 105–150 $\mu$ | | | 48 wt % | 7 wt % |
| 150–210 $\mu$ | 5 wt % | 3 wt % | 34 wt % | 3 wt % |
| 210–300 $\mu$ | | 8 wt % | 12 wt % | |
| 300–420 $\mu$ | | 28 wt % | 1 wt % | 0[a] |
| 420–600 $\mu$ | 16 wt % | 42 wt % | 0[a] | 0[a] |
| 600–840 $\mu$ | 61 wt % | 15 wt % | 0[a] | 0[a] |
| >840 $\mu$ | 16 wt % | 2 wt % | 0[a] | 0[a] |

[a]<0.5 wt %

Many foundries that cast high precision parts make the critical core elements from an expensive, low expansion high thermal capacity fine sand such as chromite or zircon that contains little or no quartz, while using cheaper sand for the less demanding molds. The use of low expansion high thermal capacity sands allows foundries to cast parts more accurately and meet more stringent tolerances than is the case with other sand. However, although costly magnetic separation has been used with limited success to separate chromite from silica sand, state of the art thermal and mechanical methods fail to distinguish between the different sand types and the expensive material cannot be recovered and reused since contamination by quite a small amount of other sand can effectively disqualify a zircon or chromite sand from use in cores. This is exacerbated by the fact that the low expansion high thermal capacity fine sand is typically a substance of higher specific gravity than the other sand.

The method of the present invention can be used to separate such sand mixtures provided the foundry selects a mold sand that has a median grain size at least twice, and preferably at least two and a half times, that of the chromite or zircon based core sand. Furthermore, the mold sand should contain (for example, by preclassification) less than 10% and preferably less than 3% of particles that are smaller than one and a half times the mean size of the chromite or zircon sand.

To minimize overlapping of the size distribution curves for the two products and contamination of one sand by the other, an additional reception trough can be introduced between those for the coarser and finer products, thereby increasing the number of fractions to five, as follows:

a) oversized particles that are returned to the controlled energy attrition unit;

b) coarse single particles of mold sand;

c) an intermediate fraction consisting of mold sand particles and some coarse particles of the chromite or zircon sand; this fraction is removed and disposed of, e.g., in non-foundry purposes;

d) a fraction consisting primarily of particles of chromite or zircon sand; and e) a fines fraction consisting mainly of particles below 0.1 mm in size.

Table 5 illustrates how a distribution into five fractions can affect the size distributions in practice, using the same feed as before. The use of low quartz or quartz-free sand reduces the quantity of quartz particles in the air which improves the working environment and reduces the incidence of respiratory disease, whilst the ability to use minerals of low chromium, nickel and/or manganese contents minimizes the potential hazard posed to soil and water pollution by waste sand that may be disposed of in a dump site.

TABLE 5

| Sieve interval | Oversize | Coarser product | Interme diate fraction | Finer product | Filter dust |
|---|---|---|---|---|---|
| 0.53μ | 3 wt % | 3 wt % | 3 wt % | 1 wt % | 58 wt % |
| 53–75μ | | | | 7 wt % | 34 wt % |
| <105μ | | | | 20 wt % | 7 wt % |
| 105–150μ | | | 3 wt % | 34 wt % | 1 wt % |
| 150–210μ | | | 10 wt % | 29 wt % | |
| 210–300μ | | 4 wt % | 43 wt % | 8 wt % | 0[a] |
| 300–420μ | 3 wt % | 29 wt % | 29 wt % | 1 wt % | 0[a] |
| 420–600μ | 16 wt % | 44 wt % | 10 wt % | 0[a] | 0[a] |
| 600–840μ | 60 wt % | 17 wt % | 2 wt % | 0[a] | 0[a] |
| >840μ | 18 wt % | 2 wt % | 0[a] | 0[a] | 0[a] |

[a]<0.5 wt %

Sand that contains at least 50 mass % of particles smaller than 2 mm in size and less then 1–2% limestone or bone or shell fragments can be converted into foundry sand quality by being processed as previously described. If only one grade of foundry sand is required, the classification plant described above will contain three chambers only, one each for oversize, foundry sand and undersize.

Sand that consists mainly of non-alkaline or slightly alkaline components but that nevertheless contains a small amount of more strongly alkaline substances such as limestone, shell fragments, wollastonite, etc., in sufficient quantity to interfere with its subsequent use, should be pre-treated as follows before being introduced to the sand recycle loop.

First, a sufficient quantity of a solution containing from 10 to 60% of a mineral acid, preferably sulphuric or nitric acid, is added to homogeneously wet the sand and reduce the pH-value of a mixture of one part of thus treated sand and three parts water to between 5 and 6. The sand is then dried to less than 0.5% volatile matter. Second, the sand is treated repeatedly in an attrition unit, such as the Barmac Duopactor®, until its content of particles smaller than 75μ has increased by at least 3% and preferably by more than 5% more than the content of such particles prior to attrition.

The addition of mineral acid converts the limestone and other contaminants to more friable moieties that can be reduced to powder during the high energy attrition step that follows. These contaminants are not effectively removed if such sand is not pre-treated in the manner described.

Whilst particularly useful as part of a foundry sand recycle, it is obvious that this procedure can be divided into two steps, i.e., pre-treatment of sand in one location for subsequent processing in another. The combination of acid pre-treatment, controlled energy attrition and classification can also be used to treat and prepare calcareous quartz sand for purposes other than making foundry sand.

As shown in Table 6, the invention described herein is a considerable improvement on state of the art recycling processes inasmuch as it leads to the production of sand that packs better, has a lower dust content and requires less binder to make satisfactory molds (including cores) than that reclaimed using conventional methods. The recovery rate is also higher than with state of the art methods. Furthermore, conventional recycling methods are of limited efficacy when used to reclaim foundry sand that contains alkaline binder residues.

TABLE 6

TYPICAL RESULTS FROM VARIOUS FOUNDRY SAND RECYCLING METHODS

| | RECLAIM METHOD | | |
|---|---|---|---|
| Feature | THIS INVENTION | THERMAL | MECHANICAL |
| Particles < 0.2 × $d_{50}$ in sand | max 1% | 2–5% | 2–5% |
| Particles > 2.5 × $d_{50}$ in sand | max 1% | max 1% | 1–3% |
| Recovery rate[a] | 92–95% | 85–95% | 85–95% |
| Limitations on reuse | none | none | yes[b] |
| Air emissions | practically none | $CO_2$, $SO_x$, $NO_x$, dust | practically none |
| Packing density of sand | 1 | 0.95–0.98 | 0.93–0.97 |
| Specific binder consumption | 1 | 1.03–1.05 | 1.05–1.10 |

[a]Compared to feed; loss is dust from impaction process
[b]Difficult to use if sand pH differs from that of binder system by more than 4 units In some cases, the surface of the mineral itself may contain small inclusions of substances that react unfavorably with the binder system such as may occur with some alkaline minerals and binder systems that use acid catalysts or contain isocyanates. This can be remedied by adding a sufficient quantity of a solution containing from 5% to 50% of an acid, preferably an aryl or aryl-alkylsuphonic acid, an aliphatic acid such as acetic or formic acid, an aromatic acid such as benzoic acid or a mineral acid such as sulphuric, nitric or phosphoric acid, or the ammonium salts of these acids, dissolved in water or alcohol, to the finished sand, i.e., after attrition and classification. If necessary the sand should be dried, although the effect of transport and storage will normally be sufficient to accomplish the necessary removal of volatiles. The amount added should be such that the sand is homogeneously wetted and acid-treated, and that a dispersion of the sand in water does not elicit a pH of more than 7.5.

Another form of pre-treatment may be necessary in order to optimize the recovery of foundry sand that contains elastic binder residues. This may be the case if the mold parts have not been heated during casting to temperatures that are sufficient to embrittle the resin binding the sand such as may occur when casting light metals. Such sand must normally be recovered by thermal means, with all that this implies in terms of increased costs and emissions. Using the present invention, however, such sand can be efficiently reclaimed by heating the sand to a temperature and for a period of time sufficient to accomplish such embrittlement, for example 300° C. for two minutes. The sand can then be treated in accordance with the procedures described herein, including a further acid pre-treatment if necessary, to remove the binder residues.

The present invention may be practiced using a variety of classifiers in conjunction with an oolitizer, as has been described. According to a preferred embodiment, however, an air classifier is used. More particularly, the present invention is best embodied using an air classifier as will now be more fully described.

III. Description of a Preferred Air Classifier

The preferred air classifier includes a horizontally disposed classification chamber having an upstream end and a downstream end. The upstream and downstream ends allow air to flow into and out of the chamber, respectively. An air suction device is located adjacent the downstream end of the chamber for drawing air through the chamber from the upstream end to create a chamber air stream. Particulate matter is fed into the chamber through a feed stream input located in an upper part of the chamber proximate the upstream end. Particles entering the chamber are entrained in the chamber air stream.

The preferred air classifier further includes a screen section situated adjacent to and upstream of the upstream end of the chamber, and a honeycomb located adjacent to and upstream of the screen section. Air entering the chamber first passes through the honeycomb, and then through the screen section. The honeycomb takes out the swirl in the air and the screen section slows down the faster moving portions of the air more than the slower moving portions. As a result, the velocity profile of the smoothed air is much more constant across the entire flow path. Particles introduced to the chamber through the feed stream input are entrained in the smoothed air as it exits the screen section.

A plurality of receiver sections are serially disposed in an upstream to downstream arrangement along the bottom of the chamber. As particles entrained in the chamber air stream fall out, these particles are collected in the receiver sections. Larger and/or heavier particles fall out sooner and are collected in receiver sections nearest the feed stream input, while smaller/lighter particles remain entrained for a longer period and are collected in receiver sections closer to the downstream end of the chamber.

In a preferred embodiment, the feed stream input includes a vibrating screen feeder which aids in separating the fine particles from the large particles at the input, permitting the air to act upon the particles more individually, and reducing the amount of fines otherwise introduced into the receiver sections intended to collect the larger particles. An upward flow of air may also be introduced within the receiver sections, moderated by screens placed above the air inlets, to keep more of the fines entrained and moving toward appropriate receiver sections.

Through the honeycomb and screen section arrangement at the upstream end of the chamber, combined with the drawing of air through the classifier by suction, air turbulence is reduced and, particularly when combined with greater separation of the incoming feed stream through vibration, the present invention makes more accurate classification of particulate matter possible.

Figure 4:
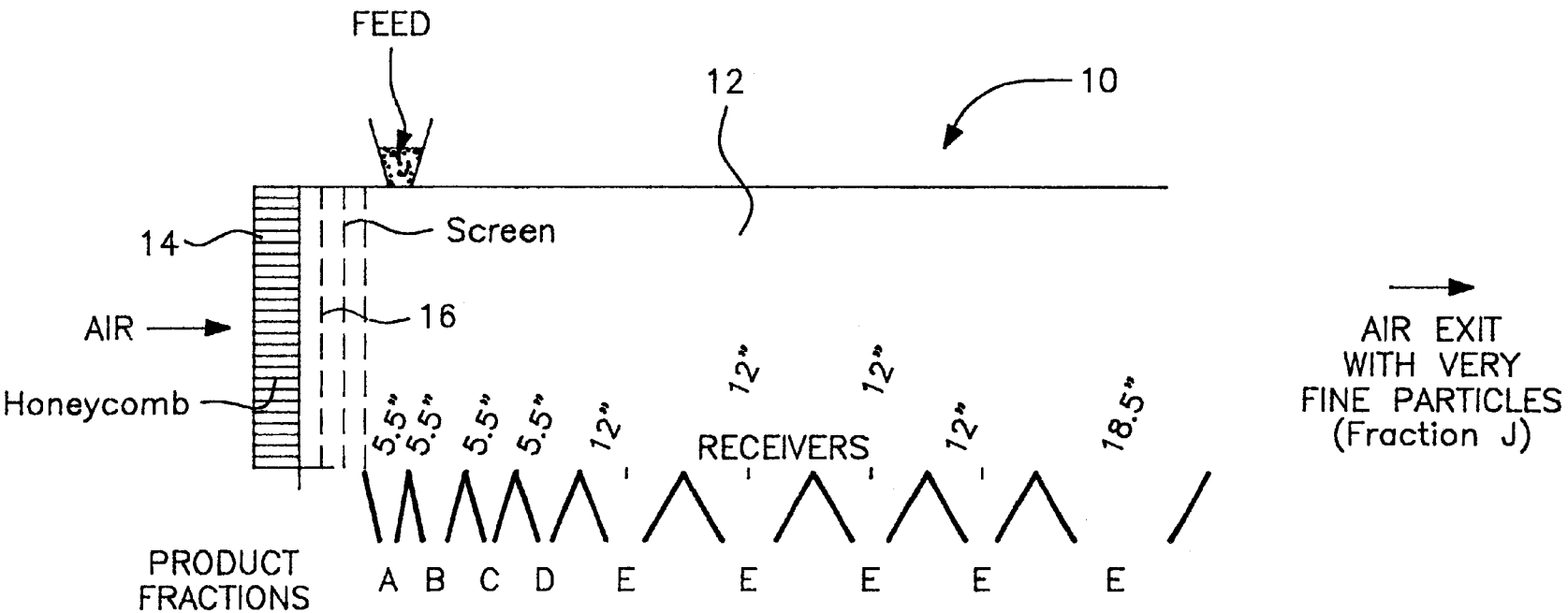
FIG. 4 shows a preferred air classifier in accordance with the present invention.

The preferred air classifier is shown representatively in FIG. 4. This air classifier 30 may be configured for operation as was shown in FIG. 3.

Air is drawn into the classifier chamber 12 through a honeycomb 14, which is followed by at least one screen 16. Particles fall from the air stream into one of a plurality of receiver sections 20. To draw the air, a blower (not shown) is placed at the exit end of the classifier, after the bag filters (not shown). The suction end of the blower is attached to the exit end of the classifier, pulling air through the classifier. This permits all the air to be pulled in from the room or atmosphere outside the classifier, where the air is quite calm compared to the air in the prior art arrangements in which the air is recycled or forced into the classifier by a fan or blower. As a result, the process of removing turbulence and swirl from the incoming air stream to obtain a uniform velocity of the classifier air containing virtually no swirl or turbulence is greatly simplified. A honeycomb is used to reduce the swirl and, due to the low swirl in the incoming air as a result of the present invention, it is possible to use honeycombs 14 with a cell length to cell diameter ratio (L/D) of only 4 to accomplish the removal of the small amount of swirl.

The cell size of the honeycomb should be less than one-tenth of the height of the longitudinal air stream. Function is improved if the cell size is smaller, and can often be $1/30$–$1/200$ of the air stream height.

In contrast to prior art classifiers, the honeycomb 14 in the present invention is placed before the screen section 16. This placement is desirable because the solid separators between the open cells of the honeycomb generate turbulent wakes in the air passing over them. The scale of this turbulence is larger than the turbulence being formed and damped by the screens; hence, it should be removed to give the smoothest air flow. Removal of such turbulence is accomplished by placing the honeycomb 14 before the screens 16. It is possible, however, to place the honeycomb after the screen section, if desired, with little loss in the efficiency of the classification.

As shown in FIG. 4, the present invention may include multiple screens 16 to smooth out the incoming air stream. In a preferred embodiment, two screens, and a maximum of three screens, are sufficient to give mean variations in velocity less than ±5% of the mean velocity when the screens are properly chosen.

To produce these results at mean air velocities of 0.5–5 meters/second, which velocities are typical of the velocities used with the present invention, the screens should have a fraction open area of 55–60%. Lower fractions of open area will also accomplish the task of smoothing the velocity profile, but at a cost of higher energy expenditure. Higher fractions of open area require the use of more screens, increasing the cost of the apparatus. The optimal choice of fraction open area of the screen is that fraction for which the minimum number of screens are required, minimizing the energy required to smooth the velocity profile and decreasing the turbulence in the air stream.

It is best to place the screens from thirty to one hundred wire diameters apart to permit the decay of the turbulence from the wires in each screen. This avoids having a screen smooth the wakes coming from the wires of the previous screen. Beyond one hundred wire diameters, these individual wakes will have disappeared for all practical purposes and the turbulent velocity fluctuations will be small scale and reduced to only 1% of the average velocity. Placing the screens farther apart increases the length of the classifier. Similar reasoning indicates that the first screen should be placed downstream of the honeycomb by 30–100 times the mean thickness of the solid separators between the individual honeycomb cells.

As a last consideration, the screens 16 should consist of wire which is sufficiently sturdy to minimize both initial cost and the maintenance/cleaning/replacement costs of the screens. Extremely fine screens, e.g., 100 mesh, can be placed close together, but they are expensive and can be blocked easily by incoming dust. Very coarse screens, e.g., 2 mesh, must be placed very far apart, increasing the length of the classifier. Practically, these limitations mean that the screens should be 2–20 mesh. As an example, an 8 mesh screen will have an opening of roughly 80 mils (2,000 microns) or about 1/12 inch. This gives a screen wire of roughly 20 mils (500 microns), which is relatively sturdy and requires the screens to be about two inches apart.

Various tests were run to evaluate the impact of the honeycomb and screen arrangement on air classifier performance. In each run, the velocity was measured (and averaged) across the classifier just upstream of the feed position for the sand. This measurement was taken with and without the honeycomb-screen section in place. Run 1 with the honeycomb-screen section in place, summarized in Table 7, had an average air flow of 1.68 mps. Run 2 without the honeycomb-screen section, summarized in Table 8, had an average air flow of 1.62 mps. This was close enough that no further adjustments were made. The sand to be classified was placed into the hopper and allowed to flow onto the moving conveyor belt. The vibrating feeder was set to 100%. The sand was observed during the runs through the viewing windows in the side of the apparatus. With the honeycomb-screen section in place the sand flow was steady and horizontal. Without the honeycomb-screen section in place the sand was observed to eddy and swirl from side to side. The fractions of sand were collected after each run was completed. Samples were taken and a sieve analysis was done to determine the separation achieved. A comparison of the data in Tables 7 and 8 shows that operation of the classifier with the honeycomb-screen section in place yields a much sharper classification of the particles.

As the larger particles fall into receiver section A at the bottom of the classifier, they carry along finer particles which have fallen with them in the upper part of the feed stream before the air begins to act on the individual particles. This phenomenon becomes more pronounced as the feed rate increases. These fines are undesirable in the product represented by the larger particles. The amount of fines in any receiver section can be reduced, sharpening the separation, by feeding air into the bottom or sides of the receiver section. This upward-rising air carries the finer particles out the top of the receiver into the main classifier air stream where they will be carried toward subsequent receiver sections where the finer particles belong. This technique can be used to decrease the fraction of fine particles falling into any receiver section. The volumetric air flow into any receiver section should be less than 1/3 the volumetric air flow in the main classifier to avoid undue disruption of the main classification action.

TABLE 7

SIZE DISTRIBUTION OF RECEIVER FRACTIONS (%) (WITH HONEYCOMB/SCREEN SECTION)

| Screen Fraction | Position Downstream from Feed Point: B | C | D | E-1 | E-2 | E-3 | E-4 | F-1 | F-2 | G | H | I | Feed % by Sum of Fractions | Feed % by Direct Sieving | Difference |
|---|---|---|---|---|---|---|---|---|---|---|---|---|---|---|---|
| Size (Microns) | | | | | | | | | | | | | | | |
| 0–38 | 0 | 0 | 0.0 | 0.0 | 0.0 | 0.0 | 0.0 | 0.0 | 0.0 | 0.0 | 0.0 | 0 | 0.0 | 0 | 0.00 |
| 38–75 | 0 | 0 | 0.0 | 0.0 | 0.0 | 0.0 | 0.0 | 0.0 | 0.0 | 0.0 | 0.0 | 2 | 0.1 | 0 | −0.11 |
| 75–90 | 0 | 0 | 0.0 | 0.0 | 0.0 | 0.0 | 0.0 | 0.0 | 0.0 | 0.0 | 0.0 | 5 | 0.3 | 0 | −0.27 |
| 90–125 | 0 | 0 | 0.0 | 0.0 | 0.0 | 0.0 | 0.0 | 0.0 | 0.0 | 1.0 | 24.0 | 58 | 4.5 | 1 | −3.52 |
| 125–150 | 0 | 0 | 0.0 | 0.0 | 0.0 | 0.0 | 0.0 | 0.0 | 1.0 | 28.0 | 54.0 | 27 | 7.1 | 3 | −4.10 |
| 150–180 | 0 | 0 | 0.0 | 0.0 | 0.0 | 0.0 | 2.0 | 20.0 | 58.0 | 58.0 | 20.0 | 8 | 12.5 | 12 | −0.46 |
| 180–212 | 0 | 0 | 0.0 | 0.0 | 1.0 | 10.0 | 28.0 | 37.0 | 26.0 | 9.0 | 2.0 | 0 | 7.2 | 9 | 1.79 |
| 212–250 | 0 | 0 | 0.0 | 23.0 | 53.0 | 69.0 | 63.0 | 40.0 | 14.0 | 3.0 | 0.0 | 0 | 16.1 | 15 | −1.05 |
| 250–300 | 1 | 0 | 18. | 60 | 35.0 | 18.0 | 4.0 | 3.0 | 1.0 | 1.0 | 0.0 | 0 | 11.6 | 12 | 0.44 |
| 300–420 | 5 | 78 | 78.0 | 17.0 | 11.0 | 3.0 | 3.0 | 0.0 | 0.0 | 0.0 | 0.0 | 0 | 32.8 | 26 | −6.73 |
| 420–500 | 11 | 8 | 3.0 | 0.0 | 0.0 | 0.0 | 0.0 | 0.0 | 0.0 | 0.0 | 0.0 | 0.0 | 2.5 | 9 | 6.44 |
| 500–600 | 31 | 7 | 0.0 | 0.0 | 0.0 | 0.0 | 0.0 | 0.0 | 0.0 | 0.0 | 0.0 | 0.0 | 2.3 | 5 | 3.56 |
| 600–710 | 41 | 6 | 1.0 | 0.0 | 0.0 | 0.0 | 0.0 | 0.0 | 0.0 | 0.0 | 0.0 | 0.0 | 2.5 | 3 | 0.45 |
| >710 | 11 | 1 | 0.0 | 0.0 | 0.0 | 0.0 | 0.0 | 0.0 | 0.0 | 0.0 | 0.0 | 0.0 | 0.5 | 0 | −0.50 |
| Total % | 100 | 100 | 100 | 100 | 100 | 100 | 100 | 100 | 100 | 100 | 100 | 100 | 100 | 95 | |
| % of | 2.5 | 22.4 | 16.4 | 7.7 | 6.7 | 5.8 | 4.1 | 7.2 | 7.0 | 9.2 | 5.5 | 5.3 | Total | 99.8 | |
| | Collected products | | | | | | | | | | | | | | |
| Weight | 57 | 515 | 377.2 | 177.5 | 155.7 | 132.2 | 96 | 164.6 | 159.4 | 212.8 | 127.4 | 123.1 | | 2297.9 | |
| Mean Size (microns) | Cumulative weight % smaller than: | | | | | | | | | | | | | (2500 gm fed) | |
| 19 | 0 | 0 | 0 | 0 | 0 | 0 | 0 | 0 | 0 | 0 | 0 | 0 | | | |
| 56.5 | 0 | 0 | 0 | 0 | 0 | 0 | 0 | 0 | 0 | 0 | 0 | 2 | | | |
| 62.5 | 0 | 0 | 0 | 0 | 0 | 0 | 0 | 0 | 0 | 0 | 0 | 7 | | | |
| 107.5 | 0 | 0 | 0 | 0 | 0 | 0 | 0 | 0 | 0 | 1 | 24 | 65 | | | |
| 137.5 | 0 | 0 | 0 | 0 | 0 | 0 | 0 | 0 | 1 | 29 | 78 | 92 | | | |
| 165 | 0 | 0 | 0 | 0 | 0 | 0 | 2 | 20 | 59 | 87 | 98 | 100 | | | |
| 196 | 0 | 0 | 0 | 0 | 1 | 10 | 30 | 57 | 65 | 96 | 100 | 100 | | | |
| 231 | 0 | 0 | 0 | 23 | 54 | 79 | 93 | 97 | 99 | 99 | 100 | 100 | | | |
| 275 | 1 | 0 | 18 | 83 | 89 | 97 | 97 | 100 | 100 | 100 | 100 | 100 | | | |
| 360 | 6 | 78 | 95 | 100 | 100 | 100 | 100 | 100 | 100 | 100 | 100 | 100 | | | |
| 460 | 17 | 86 | 99 | 100 | 100 | 100 | 100 | 100 | 100 | 100 | 100 | 100 | | | |

TABLE 7-continued

| SIZE DISTRIBUTION OF RECEIVER FRACTIONS (%) (WITH HONEYCOMB/SCREEN SECTION) | | | | | | | | | | | | |
|---|---|---|---|---|---|---|---|---|---|---|---|---|
| 550 | 48 | 93 | 99 | 100 | 100 | 100 | 100 | 100 | 100 | 100 | 100 | 100 |
| 655 | 89 | 99 | 100 | 100 | 100 | 100 | 100 | 100 | 100 | 100 | 100 | 100 |

TABLE 8

| SIZE DISTRIBUTION OF RECEIVER FRACTIONS (%) (NO HONEYCOMB/SCREEN SECTION) | | | | | | | | | | | | | | | |
|---|---|---|---|---|---|---|---|---|---|---|---|---|---|---|---|
| Screen | Position Downstream from Feed Point: | | | | | | | | | | | | Feed % by Sum of | Feed % by Direct | |
| Fraction | B | C | D | E-1 | E-2 | E-3 | E-4 | F-1 | F-2 | G | H | I | Fractions | Sieving | Difference |
| Size (Microns) | | | | | | | | | | | | | | | |
| 0–38 | 0 | 0 | 0.0 | 0.0 | 0.0 | 0.0 | 0.0 | 0.0 | 0.0 | 0.0 | 0.0 | 0 | 0.0 | 0 | 0.00 |
| 38–75 | 0 | 0 | 0.0 | 0.0 | 0.0 | 0.0 | 0.0 | 0.0 | 0.0 | 0.0 | 0.0 | 1 | 0.1 | 0 | −0.05 |
| 75–90 | 0 | 0 | 0.0 | 0.0 | 0.0 | 0.0 | 0.0 | 0.0 | 0.0 | 0.0 | 1.0 | 8 | 0.5 | 0 | −0.48 |
| 90–125 | 0 | 0 | 0.0 | 0.0 | 0.0 | 0.0 | 0.0 | 0.0 | 1.0 | 2.0 | 3.0 | 22 | 1.5 | 1 | −0.59 |
| 125–150 | 0 | 0 | 0.0 | 0.0 | 0.0 | 0.0 | 0.0 | 0.0 | 3.0 | 5.0 | 9.0 | 45 | 3.6 | 3 | −0.57 |
| 150–180 | 0 | 0 | 0.0 | 1.0 | 0.0 | 0.0 | 1.0 | 2.0 | 8.0 | 14.0 | 35.0 | 15 | 4.9 | 12 | 7.09 |
| 180–212 | 0 | 0 | 1.0 | 2.0 | 1.0 | 2.0 | 3.0 | 3.0 | 8.0 | 14.0 | 23.0 | 8 | 4.4 | 9 | 4.60 |
| 212–250 | 0 | 2 | 2.0 | 6.0 | 4.0 | 9.0 | 9.0 | 15.0 | 31.0 | 43.0 | 25.0 | 1 | 11.1 | 15 | 3.94 |
| 250–300 | 1 | 6 | 3.0 | 11 | 5.0 | 13.0 | 16.0 | 31.0 | 34.0 | 19.0 | 2.0 | 0 | 10.9 | 12 | 1.08 |
| 300–420 | 27 | 39 | 20.0 | 51.0 | 78.0 | 73.0 | 68.0 | 48.0 | 14.0 | 3.0 | 1.0 | 0 | 33.7 | 25 | −7.68 |
| 420–500 | 29 | 21 | 34.0 | 20.0 | 5.0 | 1.0 | 2.0 | 1.0 | 1.0 | 0.0 | 0.0 | 0 | 13.2 | 9 | −4.18 |
| 500–600 | 21 | 15 | 22.0 | 8.0 | 6.0 | 1.0 | 1.0 | 0.0 | 0.0 | 0.0 | 0.0 | 0 | 8.6 | 6 | −2.62 |
| 600–710 | 14 | 12 | 13.0 | 1.0 | 1.0 | 1.0 | 0.0 | 0.0 | 0.0 | 0.0 | 0.0 | 0 | 5.4 | 3 | −2.38 |
| >710 | 8 | 5 | 5.0 | 0.0 | 0.0 | 0.0 | 0.0 | 0.0 | 0.0 | 0.0 | 0.0 | 0 | 2.1 | 0 | −2.14 |
| Total % | 100 | 100 | 100 | 100 | 100 | 100 | 100 | 100 | 100 | 100 | 99 | 100 | 100 | 95 | |
| % of | 1.7 | 6.3 | 12.8 | 8.3 | 6.0 | 6.9 | 6.0 | 10.5 | 8.8 | 13.7 | 9.5 | 9.5 | Total | 100 | |
| | Collected product: | | | | | | | | | | | | | | |
| Weight | 32.7 | 122.7 | 249.2 | 162.8 | 119.3 | 135 | 118.1 | 207 | 173.1 | 259.5 | 188.7 | 185.9 | | 1954 | |
| Mean Size (microns) | Cumulative weight % smaller than: | | | | | | | | | | | | | (2500 gms. fed) | |
| 19 | 0 | 0 | 0 | 0 | 0 | 0 | 0 | 0 | 0 | 0 | 0 | 0 | | | |
| 56.5 | 0 | 0 | 0 | 0 | 0 | 0 | 0 | 0 | 0 | 0 | 0 | 1 | | | |
| 62.5 | 0 | 0 | 0 | 0 | 0 | 0 | 0 | 0 | 0 | 0 | 1 | 9 | | | |
| 107.5 | 0 | 0 | 0 | 0 | 0 | 0 | 0 | 0 | 1 | 2 | 4 | 31 | | | |
| 137.5 | 0 | 0 | 0 | 0 | 0 | 0 | 0 | 0 | 4 | 7 | 13 | 76 | | | |
| 165 | 0 | 0 | 0 | 1 | 0 | 0 | 1 | 2 | 12 | 21 | 49 | 91 | | | |
| 196 | 0 | 0 | 1 | 3 | 1 | 2 | 4 | 5 | 20 | 35 | 72 | 99 | | | |
| 231 | 0 | 2 | 3 | 9 | 5 | 11 | 13 | 20 | 51 | 78 | 97 | 100 | | | |
| 275 | 1 | 8 | 6 | 20 | 10 | 24 | 29 | 51 | 85 | 97 | 99 | 100 | | | |
| 360 | 28 | 47 | 26 | 71 | 66 | 97 | 97 | 99 | 99 | 100 | 100 | 100 | | | |
| 460 | 57 | 68 | 60 | 91 | 93 | 98 | 99 | 100 | 100 | 100 | 100 | 100 | | | |
| 550 | 76 | 83 | 82 | 99 | 99 | 99 | 100 | 100 | 100 | 100 | 100 | 100 | | | |
| 655 | 92 | 95 | 95 | 100 | 100 | 100 | 100 | 100 | 100 | 100 | 100 | 100 | | | |

The air classifier of the present invention also includes a means by which the incoming feed particles can be presented to the air stream more individually. Surprisingly, this can be done at quite high feed rates if the feed stream can enter the air stream as a more dilute curtain, with the particles spread apart evenly in the direction of air flow, recovering some of the advantage of having a uniform air stream entering the classifier. The spreading of the feed stream is best done by widening the aperture through which the feed enters the classifier and having the feed stream fall, just prior to entering the air stream, through one or two screens 18 which are vibrating, either in the direction of air flow or transverse to it. The vibrations of the screen 18 aid in separating the fine particles from the large particles, freeing them to be carried individually into the classifier air stream. It is best if the amplitude of this vibration is low, since high amplitudes can throw the particles too far and, if the frequency is high, help to avoid blockage of the screen. The amplitude should be less than 5 mm and the frequency should be above 3 cycles per second. It is best if the screen openings are at least three times larger than the diameter of the largest particles which are to pass freely through them.

When the feed stream is spread in this fashion, there is a decrease in the sharpness of separation which could be obtained in ideal operation of the classifier, since the feed is no longer entering at a single position. However, the reason the feed is being spread is because the actual operation is already far from ideal when the feed rate is high. The improvement in classification which is realized from the additional spreading obtained through an increase in the width of the feed stream more than offsets the few inches of broadening of the feed stream. However, the breadth of the feed stream in the air stream direction should not exceed ¼ of the receiver opening in the feed stream direction for an important product receiver, and ⅛ would decrease the effect even further.

Test results obtained without a vibrating screen feeder and with a vibrating screen feeder are summarized in Tables 9 and 10, respectively. These data indicate that the feed stream behaves less like a solid curtain when the stream is spread slightly in the direction of air flow. The large solids fall more freely into an earlier section and there is a cleaner separation of the particles, with fewer fine particles in each receiver.

TABLE 9

SIZE DISTRIBUTION OF RECEIVER FRACTIONS (%) (NO VIBRATING SCREEN FEEDER)

| Screen Fraction | Position Downstream from Feed Point | | | | | | | | | | |
|---|---|---|---|---|---|---|---|---|---|---|---|
| (microns) | A | B | C | D | E | F | G | H | I | J | FEED |
| >850 | | | | 1 | T | 0 | 0 | 0 | 0 | 0 | T |
| 500–850 | | | | 49 | 65 | 0 | 0 | 0 | 0 | 0 | 2 |
| 250–500 | | | | 50 | 87 | 8 | T | T | T | 0 | 44 |
| 150–250 | | | | T | 8 | 88 | 92 | 75 | 38 | T | 43 |
| 90–150 | | | | 0 | T | 4 | 8 | 25 | 42 | 1 | 4 |
| 53–90 | | | | 0 | T | T | T | T | 1 | 1 | T |
| <53 | | | | 0 | T | T | T | T | 19 | 98 | 7 |

TABLE 10

SIZE DISTRIBUTION OF RECEIVER FRACTIONS (%) (WITH VIBRATING SCREEN FEEDER)

| Screen Fraction | Position Downstream from Feed Point | | | | | | | | | | |
|---|---|---|---|---|---|---|---|---|---|---|---|
| (microns) | A | B | C | D | E | F | G | H | I | J | FEED |
| >850 | | | 1 | T | 0 | 0 | 0 | 0 | 0 | 0 | T |
| 500–850 | | | 45 | 11 | 1 | 0 | 0 | 0 | 0 | 0 | 2 |
| 250–500 | | | 54 | 89 | 85 | 13 | 1 | T | T | 0 | 44 |
| 150–250 | | | 0 | 0 | 14 | 85 | 92 | 76 | 44 | T | 43 |
| 90–150 | | | 0 | 0 | T | 2 | 7 | 24 | 49 | 2 | 4 |
| 53–90 | | | 0 | 0 | 0 | 0 | 0 | 0 | T | T | T |
| <53 | | | 0 | 0 | 0 | 0 | 0 | T | | 98 | 7 |

Figure 5:
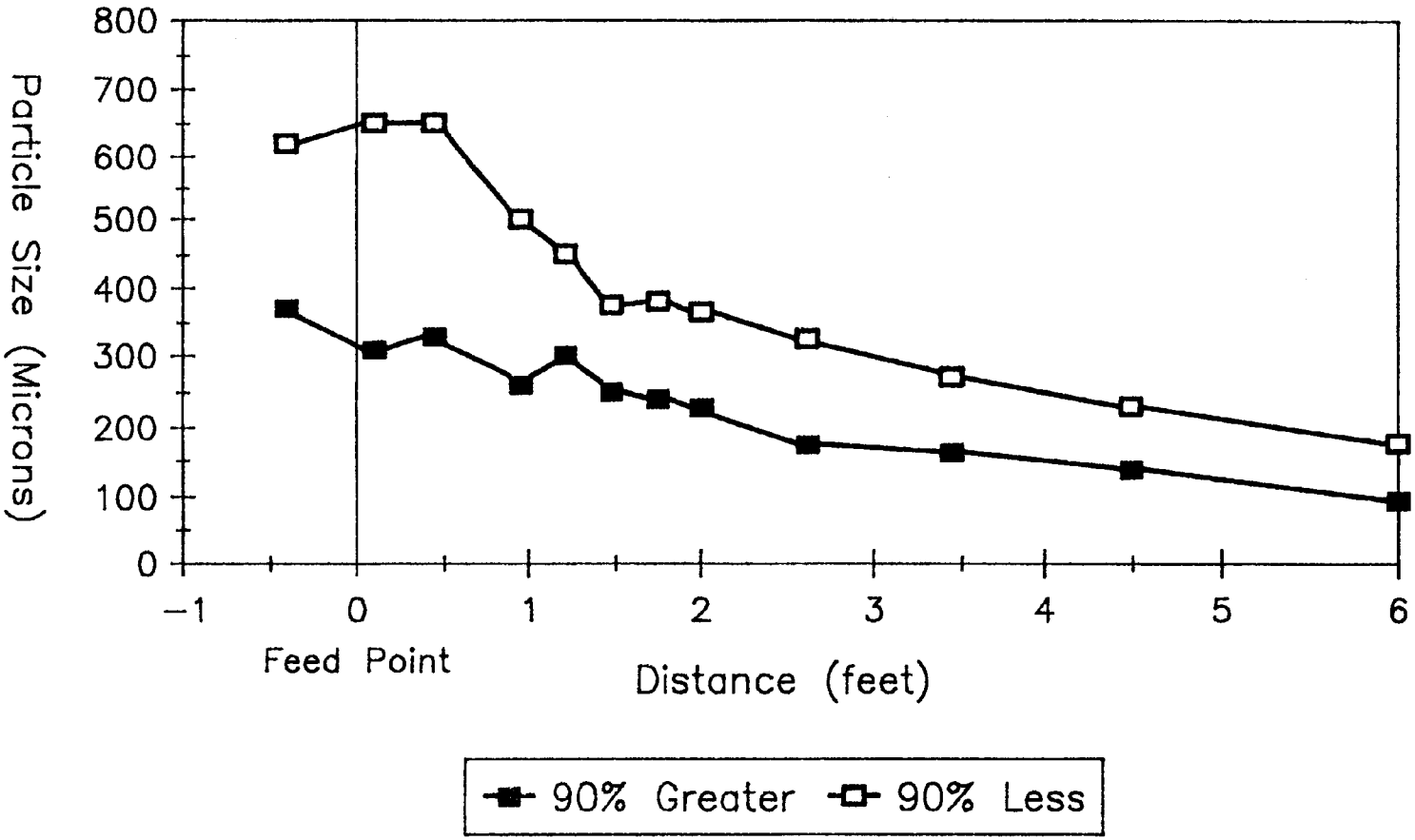
FIG. 5 is a graph depicting particle size range vs. distance for tests conducted using the preferred air classifier of FIG. 4 without a screen section and without a vibrating screen feeder.
Figure 6:
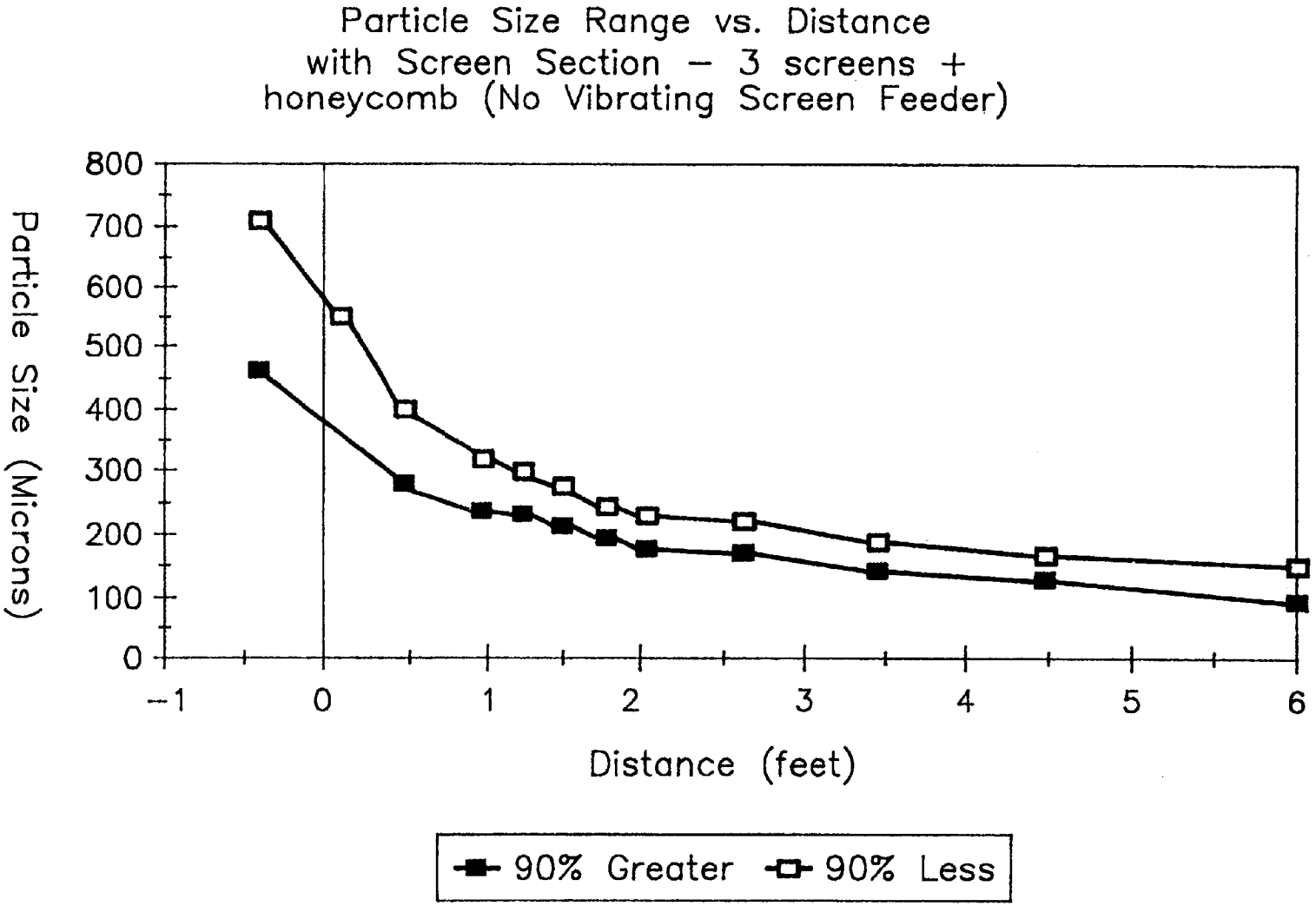
FIG. 6 is a graph depicting particle size range vs. distance using the air classifier of FIG. 4 with a screen section in place and without a vibrating screen feeder.

FIG. 5 is a graph of particle size range versus distance traveled from the feed point when using an air classifier without a honeycomb-screen section and without the use of the vibrating screen feeder 18. FIG. 6 is a graph of the same parameters, also without a vibrating screen feeder, but with a honeycomb-screen section 16 having three screens in place following the honeycomb. As shown, the inclusion of the honeycomb-screen section significantly reduces the width of the size distribution of the particles at all points.

Figure 7:
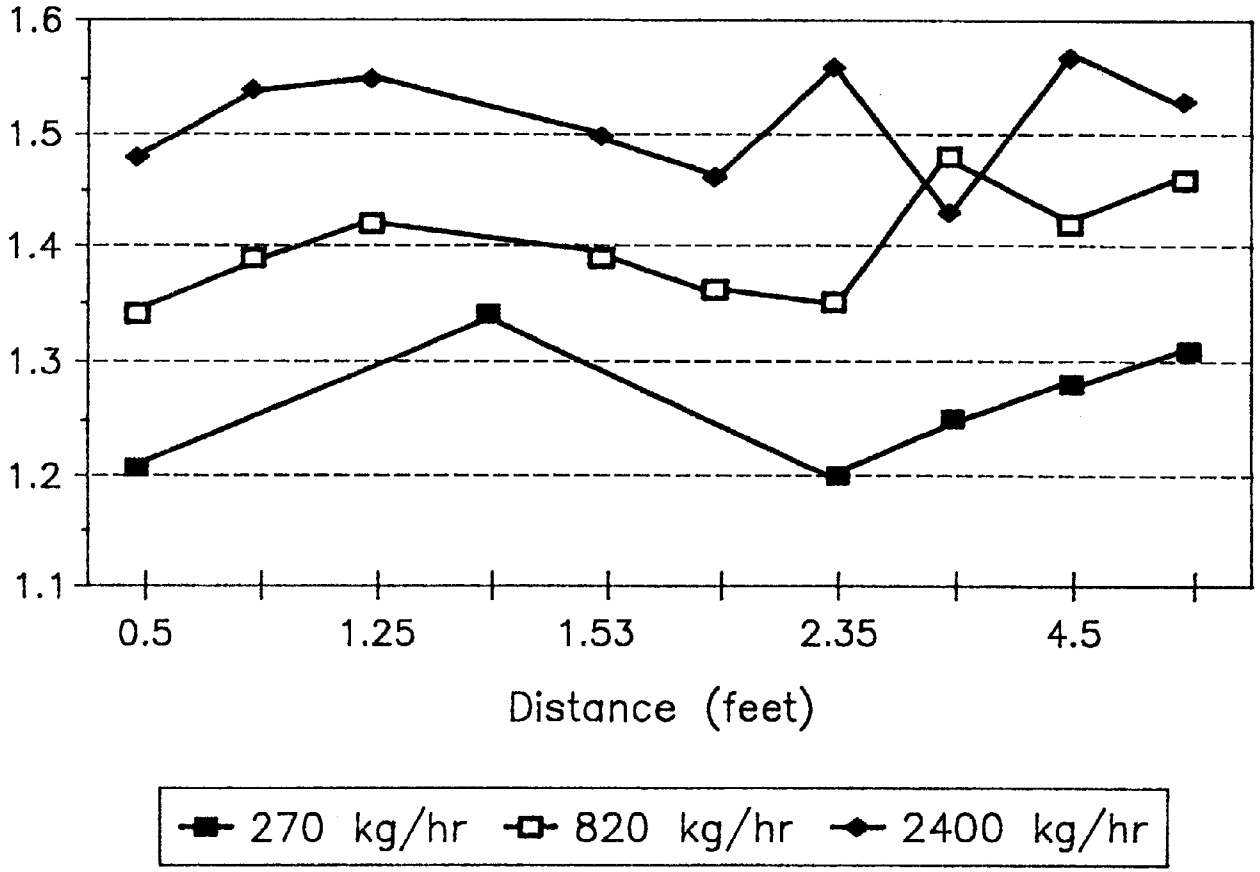
FIG. 7 is a comparative graph of performance of the preferred air classifier at three feed rates with a screen section in place.

FIG. 7 compares the performance of the air classifier at three feed rates with a honeycomb-screen section in place. The decreasing effectiveness of the separation at high feed rates is due to the increasing downward distance over which the feed particles fall as a solid curtain, disrupting the air stream and preventing the air from acting on the particles individually.

As mentioned earlier, the amount of fines in any receiver section can be reduced, sharpening the separation, by feeding air into the bottom or sides of the receiver section to give a mean upward velocity in to the air in that section. The size of the particle affected by the air being so introduced is controlled by the magnitude of the mean upward air velocity.

Figure 8:
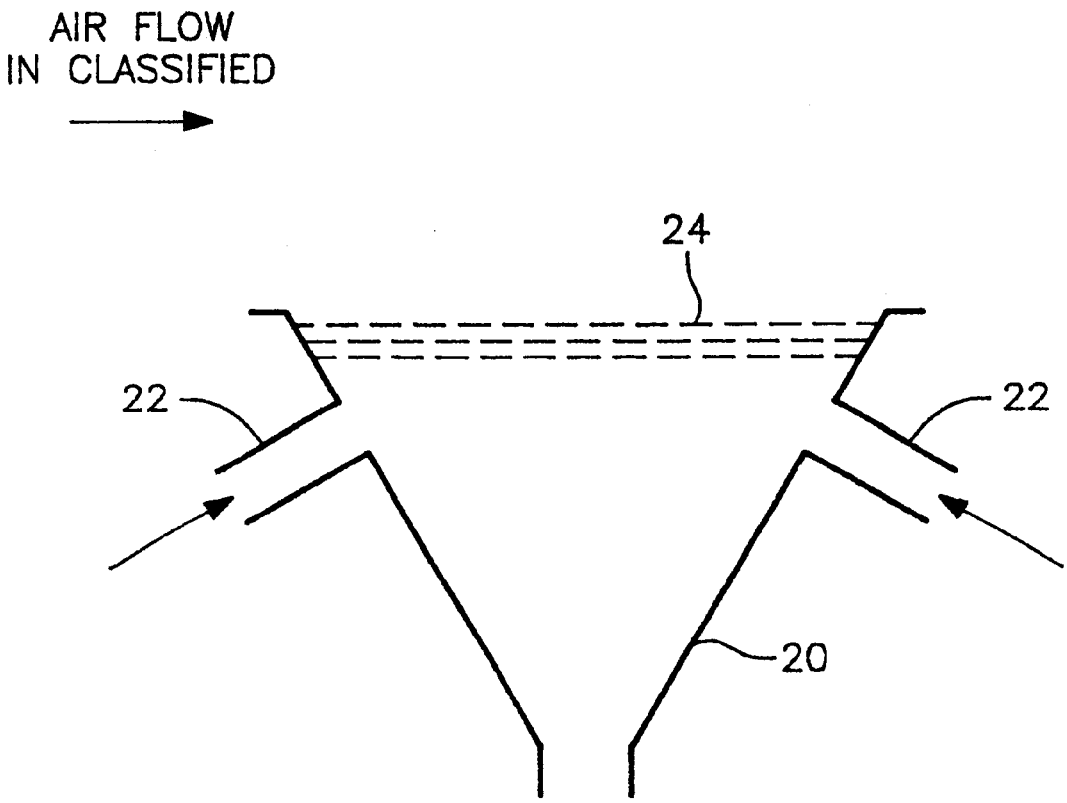
FIG. 8 illustrates an air inlet arrangement to a receiver section in accordance with the preferred air classifier.

FIG. 8 illustrates the position of two receiver air inlets 22 for the introduction of upward moving air into a receiver section 20. Also shown are screens 24 placed at the top of the receiver and above the receiver air inlets 22. Depending upon velocity, the air in these inlet streams to the receiver can introduce strong eddies; the screens 24 moderate the air flow, producing a more uniform upward velocity. The screen sections are designed in a manner similar to that used for the screen sections used for the air intake at the front of the main classifier. To avoid blockage of the receiver screens, the screen openings should be at least four times the diameter of the largest particle falling into the receiver.

Tables 11 and 12 contain size distribution of receiver fraction data from classification runs made without air and with air being blown into receiver section G of the classifier, respectively. In both Tables 11 and 12, the classifier air velocity was 1.1 m/sec and the feed rate was 5 kg/min. The letter "T" is used to signify an amount of less than 0.1 gm. In the classification runs made with air being blown into the receiver section, summarized in Table 12, the air was introduced at a mean upward velocity which would affect particles up to roughly 120 microns, decreasing the number of such particles entering that receiver. As shown by the data, the upward air flow decreases the amount of the smallest particles (<75 microns) by roughly three-fold and the next larger fraction by nearly three-fold.

TABLE 11

SIZE DISTRIBUTION OF RECEIVER FRACTIONS (%) (NO AIR FLOW IN RECEIVERS)

| Screen Fraction | Position Downstream from Feed Point | | | | | | | | | | |
|---|---|---|---|---|---|---|---|---|---|---|---|
| (microns) | A | B | C | D | E | F | G | H | I | J | FEED |
| >425 | | | 80 | 31 | 4 | 0 | 0 | 0 | 0 | 0 | 14 |
| 300–425 | | | 18 | 45 | 17 | T | 0 | 0 | 0 | 0 | 25 |
| 180–300 | | | 20 | 23 | 65 | 11 | 2 | T | T | 0 | 39 |
| 125–180 | | | T* | T | 12 | 72 | 25 | 7 | 3 | T | 10 |
| 75–125 | | | T | T | 01 | 14 | 57 | 58 | 33 | 3 | 3 |
| <75 | | | T | T | T | 2 | 16 | 34 | 64 | 96 | 9 |

TABLE 12

SIZE DISTRIBUTION OF RECEIVER FRACTIONS (%) (UPWARD AIR FLOW IN RECEIVER G)

| Screen Fraction | Position Downstream from Feed Point | | | | | | | | | | |
|---|---|---|---|---|---|---|---|---|---|---|---|
| (microns) | A | B | C | D | E | F | G | H | I | J | FEED |
| >425 | | | 83 | 52 | 5 | 0 | 0 | 0 | 0 | 0 | 14 |
| 300–425 | | | 14 | 40 | 26 | T | T | 0 | 0 | 0 | 25 |
| 180–300 | | | 2 | 8 | 64 | 44 | 5 | 1 | 1 | T | 39 |
| 125–180 | | | T* | T | 4 | 49 | 69 | 44 | 12 | 1 | 10 |
| 75–125 | | | T | T | T | 6 | 21 | 48 | 65 | 17 | 3 |
| <75 | | | T | T | T | T | 5 | 7 | 21 | 82 | 9 |

Table 13 and 14 contain similar data from classification runs made without air and with air being blown into receiver section E, respectively. In both Tables 13 and 14, the classifier air velocity was 1.1 m/sec and the feed rate was 5 kg/min. The letter "T" is used to signify an amount of less than 0.1 gm. As shown, the upward air flow reduces the amount of the fine particles in this receiver to traces.

TABLE 13

SIZE DISTRIBUTION OF RECEIVER FRACTIONS (%) (NO AIR FLOW IN RECEIVERS)

| Screen Fraction | Position Downstream from Feed Point | | | | | | | | | | |
|---|---|---|---|---|---|---|---|---|---|---|---|
| (microns) | A | B | C | D | E | F | G | H | I | J | FEED |
| >425 | | | 88 | 38 | 9 | T | T | 0 | 0 | 0 | 18 |
| 300–425 | | | 11 | 53 | 34 | T | T | T | 0 | 0 | 24 |
| 180–300 | | | T* | 8 | 53 | 44 | 3 | 1 | T | T | 36 |
| 125–180 | | | T | T | 2 | 52 | 65 | 25 | 6 | 1 | 10 |
| 75–125 | | | T | T | T | 2 | 12 | 28 | 18 | 2 | 3 |
| <75 | | | T | T | 1 | 2 | 19 | 45 | 75 | 96 | 9 |

TABLE 14

SIZE DISTRIBUTION OF RECEIVER FRACTIONS (%) (UPWARD AIR FLOW IN RECEIVER E)

| Screen Fraction | Position Downstream from Feed Point | | | | | | | | | | |
|---|---|---|---|---|---|---|---|---|---|---|---|
| (microns) | A | B | C | D | E | F | G | H | I | J | FEED |
| >425 | | | 85 | 38 | 10 | 0 | 0 | 0 | 0 | 0 | 18 |
| 300–425 | | | 14 | 53 | 32 | T | 0 | 0 | 0 | 0 | 24 |
| 180–300 | | | T* | 8 | 57 | 53 | 5 | T | T | 0 | 36 |
| 125–180 | | | T | T | T | 43 | 69 | 18 | 4 | T | 10 |
| 75–125 | | | T | T | T | 1 | 13 | 28 | 23 | 2 | |
| <75 | | | T | T | T | 2 | 12 | 53 | 72 | 96 | |

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A method of preparing foundry sand from particles of a base material, comprising the steps as ordered of:

selecting a base material including a first casting sand and a second casting sand of different specific gravities such that a median grain size of the first casting sand is at least twice a median grain size of the second casting sand;

shaping particles of said first and second casting sands through treatment in a controlled energy impactor, said treatment causing the particles to collide with one another such that surface irregularities are chipped away to produce smoothed particles; and classifying the smoothed particles with an air classifying system to produce at least two grades of finished sand corresponding to the first and second casting sands.

2. The method as set forth in claim 1, wherein the first casting sand is chromite or zircon sand and the second casting sand contains less than 10% of particles that are smaller than one and a half times a mean size of the first casting sand.

3. The method as set forth in claim 1, wherein the base material is quartz sand having at least one of chemical and physical characteristics rendering it unsuitable for use as foundry sand.

4. The method as set forth in claim 1, wherein the base material includes at least one of basalt, anorthosite, anorthite, oligoclase, gehlenite, epidote, cordierite and augite.

5. The method as set forth in claim 1, wherein the step of shaping reduces binding residues, present in the base material, to fine particles that are separated out by the air classification.

6. The method as set forth in claim 1 wherein the base material is mixed sand from used molds and cores and wherein the method further comprises, before the step of shaping, the step of crushing the used molds and cores.

7. The method as set forth in claim 6, further comprising, before the step of shaping, the step of treating the base material with a mineral acid solution to facilitate removal of alkaline residues.

8. The method as set forth in claim 3, further comprising, before the step of shaping, the step of treating the sand with a mineral acid solution to facilitate removal of alkaline substances.

9. The method as set forth in claim 7, further comprising, after the step of classifying, the step of adding an acid solution, dissolved in water or alcohol, to the finished sand such that a subsequent dispersion of the finished sand in water elicits a pH of no more than 7.5.

10. The method as set forth in claim 8, further comprising, after the step of classifying, the step of adding an acid solution, dissolved in water or alcohol, to the finished sand such that a subsequent dispersion of the finished sand in water elicits a pH of no more than 7.5.

11. The method as set forth in claim 1, further comprising, before the step of shaping, the step of pretreating the base material by heating thereof to a temperature of approximately 300° C. for about two minutes to embrittle any elastic binder residues.

12. A method of preparing foundry sand from particles of a base material, comprising the steps as ordered of:

selecting a base material including a first casting sand and a second casting sand of different specific gravities such that a median grain size of the first casting sand is at least twice a median grain size of the second casting sand;

pretreating the base material by heating thereof to a temperature of approximately 300° C. for about two minutes to embrittle any elastic binder residues;

treating the base material with a mineral acid solution to facilitate removal of alkaline residues;

shaping particles of said first and second casting sands through treatment in a controlled energy impactor, said treatment causing the particles to collide with one another such that surface irregularities are chipped away to produce smoothed particles; and classifying the smoothed particles with an air classifying system to produce at least two grades of finished sand corresponding to the first and second casting sands.

13. The method as set forth in claim 12, further comprising, after the step of classifying, the step of adding an acid solution, dissolved in water or alcohol, to the finished sand such that a subsequent dispersion of the finished sand in water elicits a pH of no more than 7.5.

* * * * *